United States Patent [19]

Agostino

[11] Patent Number: 4,872,473

[45] Date of Patent: Oct. 10, 1989

[54] DUAL FLOAT VALVE CONTROL FOR REGULAR AND DOUGLAS TYPE VALVE

[76] Inventor: Michael Agostino, 101-A Spring St., St. Augustine, Fla. 32084

[21] Appl. No.: 175,308

[22] Filed: Mar. 30, 1988

[51] Int. Cl.[4] ..... E03D 1/34; E03D 1/35

[52] U.S. Cl. ..... 137/270; 4/378; 4/393; 4/395; 4/402; 4/403; 4/404; 137/329.04; 137/433; 137/448

[58] Field of Search ..... 4/324, 325, 378, 393, 4/661, 392, 395, 402, 403, 404; 137/329.02, 329.03, 329.04, 409, 410, 448, 270, 433

[56] References Cited

U.S. PATENT DOCUMENTS

| | | | |
|---|---|---|---|
| 1,044,958 | 11/1912 | West | 137/329.04 |
| 1,668,803 | 5/1928 | Cigol et al. | 4/403 |
| 1,904,898 | 10/1933 | Kennedy | 251/362 |
| 1,946,266 | 2/1934 | Becker | 4/402 |
| 1,946,267 | 2/1934 | Becker | 4/402 |
| 1,992,381 | 2/1935 | Lyons | 4/324 |
| 2,244,982 | 6/1941 | Broberg | 137/410 |
| 2,526,294 | 10/1950 | Stegeman | 4/325 |
| 2,744,259 | 5/1956 | Dague | 4/324 |
| 2,835,900 | 5/1958 | Gleason | 4/324 |
| 2,892,197 | 6/1959 | Flieder | 4/393 |
| 3,707,733 | 1/1973 | Gore et al. | 4/393 |
| 3,921,226 | 11/1975 | Macdonald | 4/324 |
| 3,955,218 | 5/1986 | Ramsey | 4/324 |
| 4,038,707 | 8/1977 | Cass | 4/324 |
| 4,189,795 | 2/1980 | Conti et al. | 4/324 |
| 4,216,555 | 8/1980 | Detjen | 4/325 |
| 4,293,964 | 10/1981 | Riedel | 4/378 |
| 4,311,236 | 1/1982 | Johnson | 206/488 |
| 4,485,501 | 12/1984 | Kloner | 4/324 |
| 4,499,616 | 2/1985 | Johnson | 4/393 |
| 4,536,900 | 8/1985 | Hayes | 4/324 |
| 4,698,859 | 10/1987 | Freed | 4/392 |
| 4,784,699 | 6/1988 | Stevens | 4/324 |

FOREIGN PATENT DOCUMENTS

| | | | |
|---|---|---|---|
| 494152 | 7/1953 | Canada | 137/410 |

*Primary Examiner*—George L. Walton

*Attorney, Agent, or Firm*—Arthur G. Yeager; Earl L. Tyner

[57] ABSTRACT

A reversible buoyant and non-buoyant flush tank valve is adapted for use in various types of flush tanks each having different selective valve operating attachments for moving the valve. The valve for use in one type of tank includes an elongated base with opposite end portions with a valve operating attachment selectivity at one end for opening and closing the valve. The other end portion of the valve is selectively attachable to the overflow pipe. The base has opposite sides with a vertically extending hollow frusto-conical cup member on one side. When the valve is used in another type of tank the opposite end portions are removed for connecting a vertical rod valve operating attachment to a first and second oppositely disposed bores to selectively position the cup member upwardly for non-buoyant operation or downwardly for buoyant operation.

19 Claims, 2 Drawing Sheets

DUAL FLOAT VALVE CONTROL FOR REGULAR AND DOUGLAS TYPE VALVE

RELATION TO PRIOR APPLICATIONS

This application is related to the following copending applications: "Dual Flush Valve Assembly", Ser. No. 030,369, filed May 26, 1987; "Solid Flush Valve"Ser. No. 111,345, filed Oct. 22, 1987; "Buoyant and non-buoyant valve", Ser. No. 132,319, filed Dec. 14, 1987; and "Dual Mode Flush Control Valve", Ser. No. 158,880, filed Feb. 22, 1988.

BACKGROUND OF THE INVENTION

1. FIELD OF THE INVENTION

The present invention relates to a flush tank valve adapted to be operated by either a pull strap or a vertical rod in either the buoyant or non-buoyant position to vary the amount of water used in a flushing operation.

1. PRIOR ART

Flush tank valves are well known in the art but no unitary valve that is presently known can be operated in either the buoyant or non-buoyant mode by either a pull strap or vertical rod valve operating mechanism. The present invention is therefore adaptable for use with a wider variety of flush tanks than are the valves disclosed in the prior art including U.S. Pat. Nos. 1,904,898; 2,835,900; 3,707,733; 3,921,226; 4,038,707; 4,189,795; 4,311,236; and 4,499,616.

SUMMARY OF THE INVENTION

In accord with the present invention there is provided a buoyant and non-buoyant flush tank valve for use in various flush tanks having different selective valve operating means for moving said valve, a water inlet, an inlet valve, a water outlet with a valve seat thereat selectively closable by the valve and an upstanding overflow pipe adjacent the water outlet. The valve comprises an elongated base with opposite end portions, the base having at one of its end portions first attachment means for selectively connecting a valve operating means thereto for moving the valve to a first position in which the valve is open and a second position in which the valve is closed on the valve seat. The base has at another of its end portions first mounting means for selectively attaching the valve onto an upstanding overflow pipe for movement between the first and second positions. The elongated base has opposite generally planar sides and a generally vertical extending hollow frusto-conical cup member on one of its sides defining an interior surface with the cup member being disposed downwardly when the flush valve is mounted in a buoyant position and located within the water outlet when the flush valve is in its second position and being disposed upwardly when the flush valve is mounted in a non-buoyant position. The base has second attachment means for selectively connecting a valve operating means thereto including first and second oppositely disposed bores having interior threads which are affixed to the base. The first bore is adapted to be selectively engaged by a substantially vertical rod having exterior threads at the lower end portion thereof for disposing the cup member downwardly or the second bore for disposing the cup member upwardly. The second attachment means is selectively connected to a valve operating means via a substantially vertical rod for movement in the vertical direction to move the valve between the first and second positions.

Several aspects are seen wherein the first attachment means includes a forwardly extending tab on the base and an opening therethrough for connection to the valve operating means. The tab is adapted to be removable from the base when the second attachment means is selected. The first mounting means includes pivotable means for attachment to an upstanding overflow pipe and includes at least two spaced openings for adjusting the angle of the valve when the valve is in the second position, the openings being formed in the other end portion and located in generally vertical alignment. The other end portion of the base includes a pair of laterally disposed arms integral with and extending rearwardly from one end portion, each of the arms having two spaced openings therethrough and forming the pivotal means for pivotally mounting the valve. The pivotal means is adapted to be removable from the base when the second attachment means is selected.

In other aspects the first and second bores are integral with a tubular insert, the insert being vertically disposed and affixed within the base. The first and second threaded bores are separated by a partition at the interior ends thereof for prevention of fluid flow from one bore to the other bore. The bores are vertically disposed generally centrally within the cup member.

Additional aspects of the invention are found herein with the base including a passageway communicating between the edge of one end portion of the base and the interior surface of the cup member and an elongated strap having opposing end portions, one of which is positioned within the passageway and the other being adapted for connection to a valve operating means for upward movement of the valve between the first and second positions to dispose the cup member upwardly and downwardly. The strap includes a shoulder on the terminus of one end portion, the shoulder engaging the inner surface of the cup member for lifting the valve when tension is placed on the strap by selective movement of a valve operating means to move the valve to the first position. Another attachment means includes a rubber strap having opposite end portions, one end portion of the strap having stop means adjacent the terminus thereof and being positioned through said opening in a tab. The stop means is below and engaged with the tab and another of the end portions of the strap being adapted for connection to a valve operating means for upward movement of the valve between the first and second positions. The valve has planar sides which include a generally hemispherical protuberance oppositely disposed from and substantially symmetrical about a vertical axis passing through the cup member and the protuberance and which is disposed within a water outlet when the valve is mounted in a non-buoyant position and is in the second position.

BRIEF DESCRIPTION OF THE DRAWINGS

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings, in which:

DETAILED DESCRIPTION OF THE PREFERRED EMBODIMENT

Figure 1:
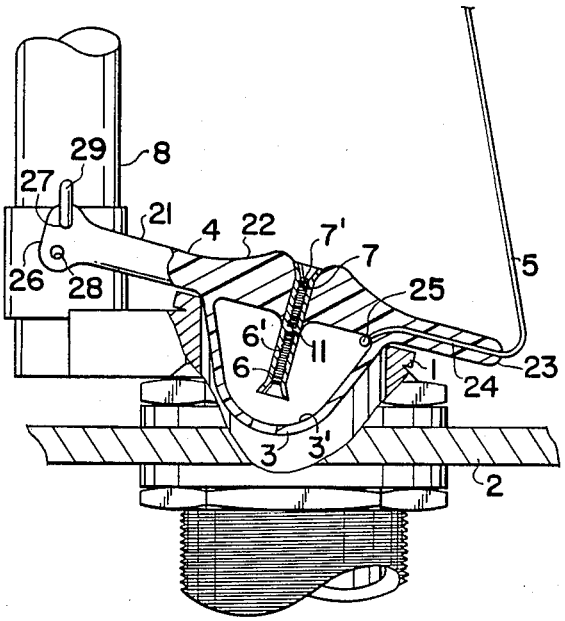
FIG. 1 is a cross-sectional view of the valve in accord with the present invention used in a buoyant position and illustrating an embodiment of the connecting strap for pivotal operation of the valve in one type of flush tank.
Figure 2:
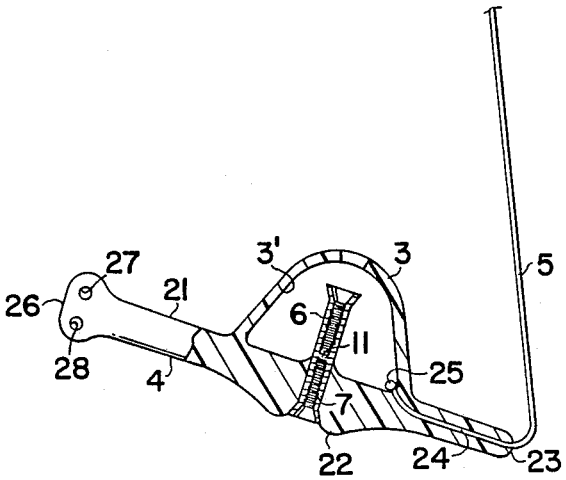
FIG. 2 is a cross-sectional view of the valve of FIG. 1 in the non-buoyant position.

With reference now to the drawings, the unitary and reversible dual float valve in accord with the present invention is depicted by the numeral 20 in FIG. 1. The valve 20 has an elongated body or base 21 with a generally hemispherical protuberance 22 on one generally planar side. One end of the body 21 has an edge portion 23 through which a passageway 24 is formed. The passageway 24 communicates with the interior surface 3' of a hollow frusto-conical cup member 3 integral to the other generally planar side of body 21. A strap 5 fits within passageway 24 and may have one end secured within cup member 3 by a knot or shoulder 25 or any other molded integrally with the remainder of the valve 20 as is common in the art, as long as the strap 5 exits approximately midway of the sides and out end 23', as illustrated in FIGS. 1 and 2, as would be well known in the art.

Oppositely disposed threaded bores 6 and 7 are formed as a tubular insert with interior threads 6' and 7' respectively and are separated by partition 9. As will be explained in more detail hereinbelow, the bores 6 and 7 are used to connect the valve 20 for vertical operation.

In FIG. 1 the valve 20 is positioned for buoyant operation and is pivotally mounted to overflow pipe 8 via rearwardly extending arms 4 formed to have two spaced openings 27 and 28 arranged in vertical alignment in the rearward portion 26 of arms 4. Overflow pipe 8 has a pair of laterally extending pins 29 onto which either opening 27 or 28 are secured to adjust the valve to the proper angle when it is closed onto the valve seat 1, as shown in FIG. 1.

Figure 3:
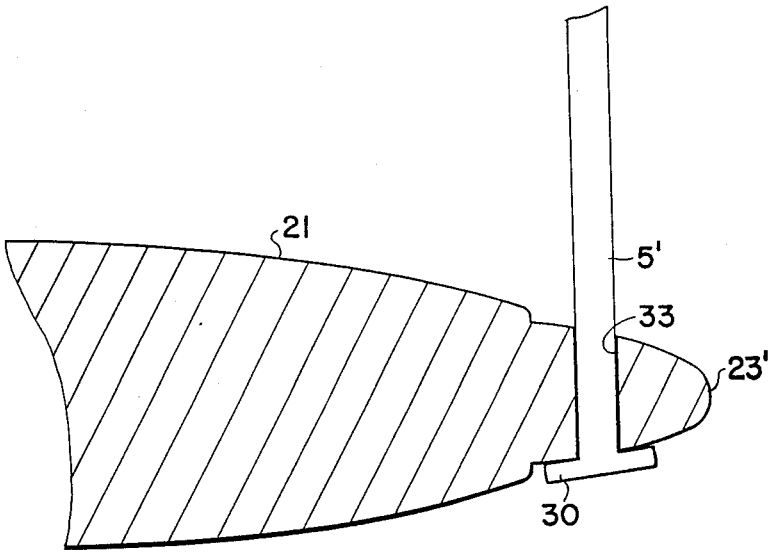
FIG. 3 is an enlarged partial cross-sectional view of one end of the valve of FIG. 2 illustrating another embodiment of the connecting strap to the valve for pivotal operation.
Figure 4:
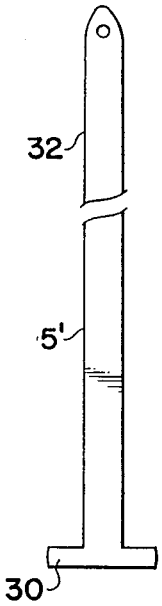
FIG. 4 is an enlarged illustration of the rubber strap used in FIG. 3.

An alternative embodiment of the strap 5 is the rubber strap 5', illustrated in FIG. 3. The strap 5' has a stop 30 at one end and fits through an opening 33 in a tab 23' on the body 21. The strap 5' is adapted at its upper portion 32 for connecting it to a valve operating mechanism, as well known in a flush tank.

Figure 5:
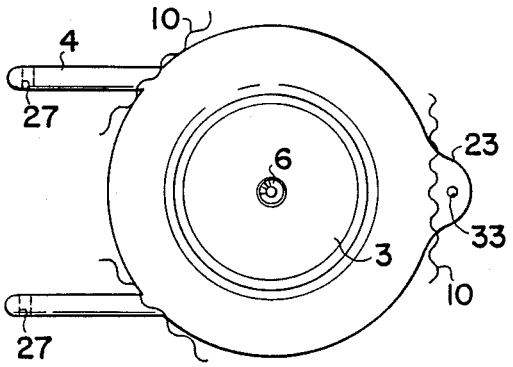
FIG. 5 is a top plan view of the valve utilizing the strap of FIGS. 3 and 4 illustrating the, portions of the valve to be removed when used in another type of flush tank.
Figure 6:
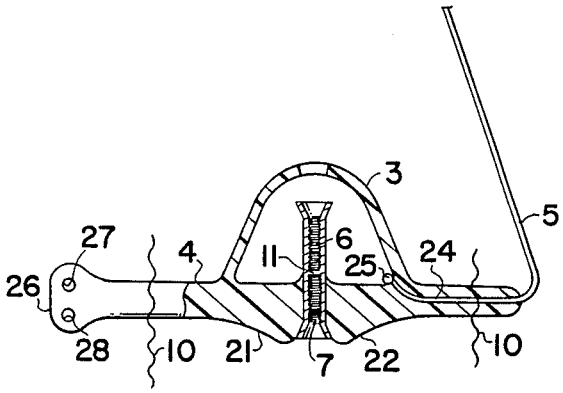
FIG. 6 is a cross-sectional view of the valve of FIGS. 1–2 as adapted for vertical operation.
Figure 7:
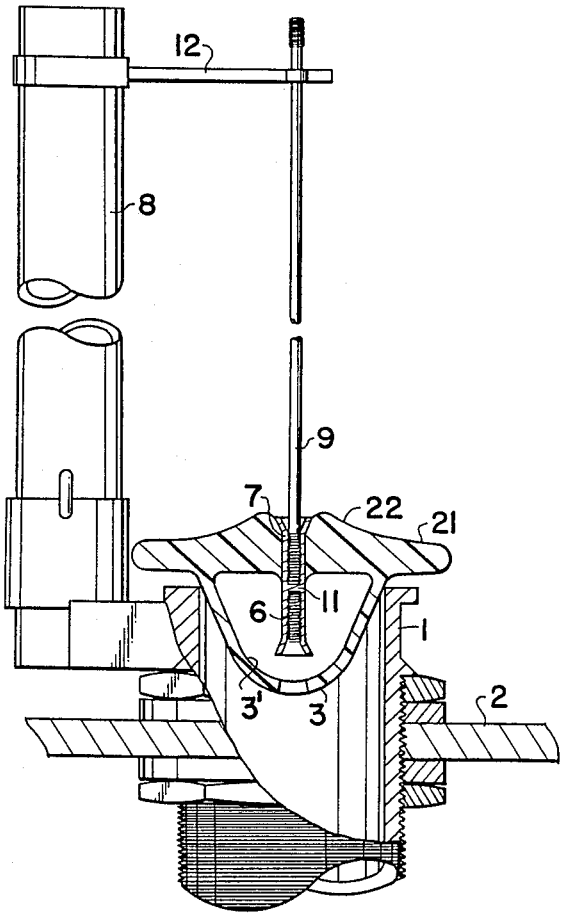
FIG. 7 is a cross-sectional view of the valve of FIG. 6 positioned for buoyant operation and shown attached to a vertical connecting rod.
Figure 8:
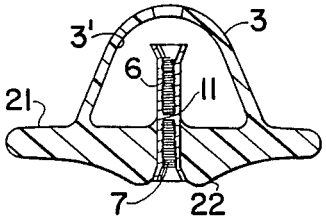
FIG. 8 is a cross-sectional view of the valve shown in FIG. 7 in the non-buoyant position.

As illustrated in FIGS. 5 and 6, the arms 4 and tab 23' are adapted to be removed by cutting along lines 10. These portions are removed when the valve 20 is to be secured to a valve operating mechanism 12 via vertical rod 9 as shown in FIG. 7. The valve 20 can be positioned for the buoyant mode by threading rod 9 into bore 7, as shown in FIG. 7, or the valve 20 can be operated in a non-buoyant mode, as shown in FIG. 8, by threading the rod 9 into bore 6. In FIG. 8, the upwardly disposed position of cup member 3 allows the interior surface 3' to be flooded thereby rendering valve 20 non-buoyant. Partition 11 prevents water or air from passing between bore 6 and 7 to insure proper operation of the valve 20 in its chosen mode. Finally, as understood in the art, the protuberance 22 or cup member 3 fits into the outlet space of valve seat 1 which is attached to the flush tank via threaded nut 2.

The valve 20 can thus be operated between open and closed positions by (1) connecting strap 5 through passageway 24 and mounting the valve 20 on the pins 29 via opening 27 or 28 for pivotal operation; or (2) the valve 20 can be pivotally mounted on pin 29 and operated by strap 5'; or (3) operating the valve 20 via rod 9 connected to either bore 6 or bore 7. And the valve 20 can be positioned for either buoyant or non-buoyant operation with any of the attachment means discussed herein above.

In summary, a buoyant and non-buoyant reversible flush tank valve 20 for use in a flush tank is provided and includes an elongated base 21 with opposite end portions having at one of its end portions first attachment means for selectively connecting a valve operating means 12 thereto for moving the valve to a first position in which the valve is open and a second position in which the valve is closed on a valve seat 1, the base 21 having at another of its end portions first mounting means for selectively attaching the valve 20 onto an upstanding overflow pipe 8 for movement between the first and second positions. The elongated base 21 has opposite generally planar sides and a generally vertical extending hollow frusto-conical cup member 3 on one of its sides defining an interior surface 3' and being disposed downwardly when the flush valve 20 is mounted in a buoyant position and located within the water outlet when the flush valve 20 is in the second position and being disposed upwardly when the flush valve 20 is mounted in a non-buoyant position. The base 21 has a second attachment means for selectively connecting a valve operating means 12 thereto including first and second oppositely disposed bores 7 and 6 having interior threads 7' and 6' separated by partition 11. The said first bore 7 is adapted to be selectively engaged by a substantially vertical rod 9 having exterior threads at the lower end portion thereof for disposing the cup member 3 downwardly, or the second bore 6 for disposing the cup member 3 upwardly.

The first attachment means includes a forwardly extending tab 23' on the base 21 and an opening 33 therethrough for connection to the valve operating means 12. The tab is adapted to be removable from the base 21 when the second attachment means is selected. The first mounting means uses pivotable means for attachment to an upstanding overflow pipe 8. The other end portion of the base includes a pair of laterally disposed arms 4 integral with and extending rearwardly from one end portion, each of the arms 4 having an opening therethrough and forming the pivotal means for pivotally mounting the, valve 20. Each arm has at least two spaced openings 27 and 28 for adjusting the angle of the valve 20 when valve 20 is in the second position, the openings 27, 28 on each arm 4 being formed and located in generally vertical alignment.

Alternatively, as shown in FIG. 1, the base 21 includes a passageway 24 communicating between the edge 23 of one end portion of the base 21 and the interior surface 3' of the cup member 3. The elongated strap 5 has opposing end portions. One of the end portions of the strap 5 being positioned within the passageway 24, another of the end portions 32 of the strap 5 being adapted for connection to a valve operating means 12 for upward movement of the valve 21 between the first and second positions to dispose the cup member 3 upwardly and downwardly. The strap 5 includes a shoulder 25 on the terminus of one end portion, the shoulder 25 engaging the inner surface 3' of the cup member 3 for lifting the valve 21 when tension is placed on the strap 5' by selective movement of a valve operating means 12 to move the valve 21 to said first position. Another attachment means includes rubber strap 5' having opposite end portions, one end portion of the strap having stop means 30 adjacent the terminus thereof and being positioned through the opening 33 in the tab 23' with the stop means 30 being below and engaged with the tab 23'. The other end portion 32 of the strap 5' being adapted for connection to a valve operating means for upward movement of the valve between the first and second positions.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A unitary and reversible buoyant and non-buoyant flush tank valve adapted for use in various types of flush tanks each having a different selective valve operating means for moving said valve, a water inlet, an inlet valve, a water outlet with a valve seat thereat selectively closable by said valve and an upstanding overflow pipe adjacent the water outlet, said valve comprising an elongated base with opposite end portions, said base having at one of its said end portions first attachment means for selectively connecting the valve operating means thereto for moving said valve to a first position in which said valve is open and a second position in which said valve is closed on the valve seat, said base having at another of said end portions first mounting means for selectively attaching said valve onto the upstanding overflow pipe for movement between said first and second positions, said elongated base having opposite generally planar sides and a generally vertical extending hollow frusto-conical cup member on one of said sides defining an interior surface, said base and said cup member being reversible between a buoyant and non-buoyant position, said cup member being selectively disposed downwardly when said flush valve is mounted in the buoyant position and located within the water outlet when said flush valve is in said second position, said cup member being selectively disposed upwardly when said flush valve is mounted in the non-buoyant position, said base having second attachment means for selectively connecting the valve operating means thereto, said second attachment means including first and second oppositely disposed bores having interior, threads, said bores being affixed to said base, said first bore being adapted to be selectively engaged by a substantially vertical rod having exterior threads at the lower end portion thereof for disposing said cup member downwardly, or said second bore for disposing said cup member upwardly, said second attachment means being selectively connected to the valve operating means via the substantially vertical rod for movement in the vertical direction to move said valve between said first and second positions, wherein only one of said mounting means being selective depending on which different valve operating means is to be utilized with said flush valve in the various types of flush tanks.

2. The valve as defined in claim 1 wherein said first attachment means includes a forwardly extending tab on said base and an opening therethrough for connection to the valve operating means.

3. The valve as defined in claim 2 wherein said tab is adapted to be removable from said base when said second attachment means is selected.

4. The valve as defined in claim 2 wherein said first attachment means further includes a strap having opposite end portions, one said end portion of said strap having stop means adjacent the terminus thereof, said strap being positioned through said opening in said tab, said stop means being below and engaged with said tab, another of said end portions of said strap being adapted for connection to the valve operating means for upward movement of said valve between said first and second positions.

5. The valve as defined in claim 4 wherein said strap is a rubber member.

6. The valve as defined in claim 5 wherein said first bore is vertically, generally centrally disposed within said protuberance.

7. The valve as defined in claim 1 wherein said first mounting means includes pivotable means for attachment to the upstanding overflow pipe.

8. The valve as defined in claim 7 wherein said pivotable means includes at least two spaced openings for adjusting the angle of said valve when said valve is in said second position, said openings being formed in said other end portion and located in generally vertical alignment.

9. The valve as defined in claim 7 wherein said other end portion of said base includes a pair of laterally disposed arms integral with and extending rearwardly, from said one end portion, each of said arms having an opening therethrough and forming said pivotal means for pivotally mounting said valve.

10. The valve as defined in claim 9 wherein each said arm has at least two spaced openings for adjusting the angle of said valve when said valve is in the second position, said openings on each arm being formed and located in generally vertical alignment.

11. The valve as defined in claim 1 wherein said first and second bores are integral with a tubular insert, said insert being vertically disposed and affixed within said base.

12. The valve as defined in claim 1 wherein said first and second threaded bores are separated by a partition at the interior ends thereof for prevention of fluid flow from one said bore to the other said bore.

13. The valve as defined in claim 7 wherein said pivotal means is adapted to be removable from said base when said second attachment means is selected.

14. The valve as defined in claim 11 wherein said second bore is vertically disposed generally centrally within said cup member.

15. The valve as defined in claim 1 wherein said base includes a passageway communicating between the edge of said one end portion of said base and said interior surface of said cup member, an elongated strap having opposing end portions, one of said end portions of said strap being positioned within said passageway, another of said end portions of said strap being adapted for connection to the valve operating means for upward movement of said valve between said first and second positions to dispose said cup member upwardly and downwardly.

16. The valve as defined in claim 15 wherein said strap includes a shoulder on the terminus of said one end portion, said shoulder engaging said inner surface of said cup member for lifting said valve when tension is placed on said strap by selective movement of the valve operating means to move said valve to said first position.

17. The valve as defined in claim 1 wherein said other planar side of said base includes a generally hemispherical protuberance oppositely disposed from and substantially symmetrical about a vertical axis passing through said cup member and said protuberance, said protuberance being disposed within a water outlet when said valve is mounted in the non-buoyant position and is in said second position.

18. The valve as defined in claim 1 wherein said first attachment means and said first mounting are each adaptable to be removable from said base when said second attachment means is selected.

19. The valve as defined in claim 1 wherein each said arm is adaptable to be removable from said base when said second attachment means is selected.

* * * * *